United States Patent [19]

Stewart et al.

[11] 4,063,395

[45] Dec. 20, 1977

[54] TWIN MEMBRANE, SELF SEALING, MECHANICALLY FASTENED INSULATED ROOF DECK SYSTEM

[75] Inventors: Sherman A. Stewart, Rancho Palos Verdes, Calif.; Estel R. Snyder, La Grange, Ill.; David L. Ruff, Harbor City, Calif.

[73] Assignee: Grefco, Inc., Bala Cynwyd, Pa.

[21] Appl. No.: 468,885

[22] Filed: May 10, 1974

[51] Int. Cl.[2] ..... E04D 1/28; E04D 1/36

[52] U.S. Cl. ..... 52/309.5; 52/309.8; 52/417; 52/437; 52/509; 220/9 F

[58] Field of Search ..... 52/509, 309, 416, 417, 52/418, 410, 577, 576, 437, 582, 546, 541, 90, 261, 408, 409, 411, 412, 440, 302, 303, 405, 471, 439

[56] References Cited

U.S. PATENT DOCUMENTS

| | | | |
|---|---|---|---|
| 2,196,807 | 4/1940 | Eckert | 52/416 |
| 2,861,525 | 11/1958 | Curtis | 52/408 |
| 3,367,492 | 2/1968 | Pratt | 220/9 F |
| 3,449,879 | 6/1969 | Bloom | 52/437 |
| 3,581,779 | 6/1971 | Sylvia | 52/309 |

FOREIGN PATENT DOCUMENTS

| | | | |
|---|---|---|---|
| 1,183,520 | 12/1964 | Germany | 220/9 F |
| 860,814 | 2/1961 | United Kingdom | 52/404 |
| 1,004,736 | 9/1965 | United Kingdom | 52/471 |

*Primary Examiner*—John E. Murtagh
*Attorney, Agent, or Firm*—Everett H. Murray, Jr.

[57] ABSTRACT

A roofing system comprising a fire resistant rigid class A fire rated board as a substrate having bonded thereto a sheet of foamed, insulating resin and having a tough weather resistant membrane bonded to the upper surface. A ledge of substrate about ½ inch wide protrudes beyond the formed sheet to enable the composite to be fastened to a steel roof or the like by mechanical fasteners. The channel formed by the abutting roofing panels is filled with insulating foam and covered with a membrane strip which is attached at its edges to the membrane surface of the roofing panel.

5 Claims, 8 Drawing Figures

FIG. 4
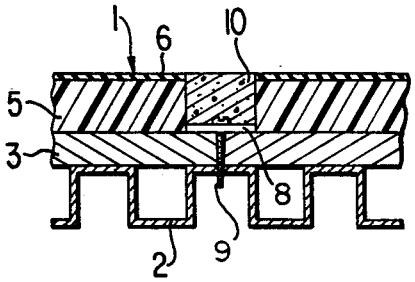
FIG. 5
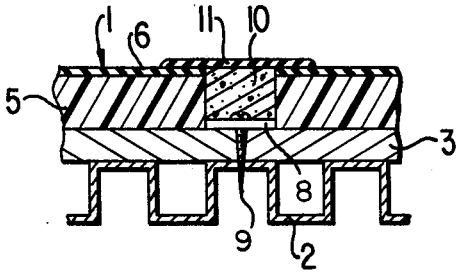
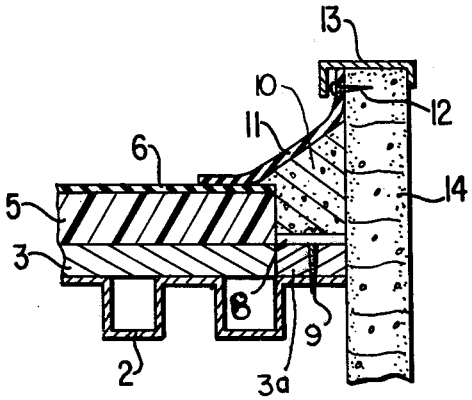
FIG. 6
FIG. 7
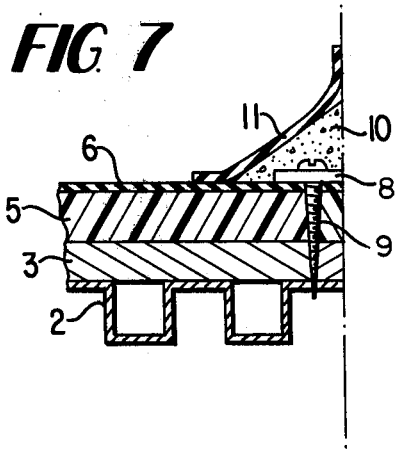
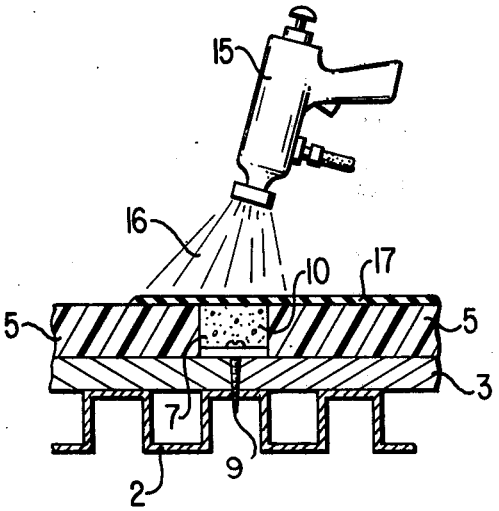
FIG. 8

TWIN MEMBRANE, SELF SEALING, MECHANICALLY FASTENED INSULATED ROOF DECK SYSTEM

BACKGROUND OF THE INVENTION

This invention relates to a new roof structure and the method for making it.

Existing methods of applying insulating and/or sealing membranes to flat and slightly sloping roofs have several disadvantages. The hot or cold adhesives employed heretofore are diffucult to apply properly in the field, and are subject to deterioration by weathering and by fire. Usually the head of the mechanical fastener employed projects above the insulation layer, resulting in a condensation points on the interior of the roof and a focal point for patch ice to form on the exterior surface. The use of elastomeric or plastic membranes as a top surface layer on the roofing materials has not been very successful due to the dependency on field application of adhesives to fasten the membranes to the substrate and the lack of a dependable method for joint sealing in the field.

SUMMARY OF THE INVENTION

The invention consists of rigid polygonal insulated substrates which are fastened to a roof deck. Bonded to said substrates are similarly shaped substantially closed cell foamed insulating cores or sheets. Said sheets in turn have bonded thereto at their upper faces a durable fiber- or fabric-reinforced tough elastomer or plastic membrane having excellent weather resistant properties, thereby forming a double membrane roofing panel. Since the laminae are bonded at the factory, problems of applying adhesives in the field are minimized. Where improved fire resistance is desired, substrates meeting the requirments for Class A fire resistance and made from inorganic, preferably low density insulating material, such as for example, expanded vermiculite, perlite, shale or the like will be employed. The perimeter of the rigid substrate extends slightly beyond the edges of the insulating sheet or core to form a ledge of ½ to 1 inch wide.

In laying the roof, following one embodiment, the roofing panels are placed in abutting positions. Washers are positioned over the ledges and mechanical fasteners (staples, nails or screws, etc.) are driven through the washer and ledges to attach the panels to the roof deck. A channel or slot is formed where the units abut each other and this is filled with an insulating joint sealer which may be of a foam-type which is smoothed off so as to be level with the surface of the insulating units. A covering strip of similar thickness and of the same or different material as the outer membrane is then laid over the sealer and filler and cemented to the membrane, but not to the sealer. The latter is important since this provides for differential movement between the substrate and the covering strip, which aids in preventing damage to said strip. Where strips cross over each other, a compatible mastic is employed to fill any small voids. If the joint sealer and covering strip are sufficiently elastic, and the sealer acts in an essentially integral manner with the panel and core, the sealer may be adhesively fastened to the strip.

An object of this invention is to provide a novel double membrane roofing panel having a bottom substrate, a foam core and a top membrane covering having a ledge on the substrate extending beyond the foam core.

Another object of this invention is to provide a means for mechanically fastening double membrane roofing panels to the roof deck while providing adequate insulation above the mechanical fastener, and to shield the mechanical fastener from extremes of weather and thus prevent its loosening.

Still another object of this invention is to provide a joint seal for mechanically locking individual factory produced composite roofing panels into a single monolithic mass, to insulate and shield the mechanical fasteners, and to adhere to all vertical surfaces projecting through the roof deck.

A further object of this invention is to provide a top sealing membrane covering the joint seal and protecting the latter from the weather.

Still another object of this invention is to provide for necessary expansion and contraction of the roof surface structure while preventing mechanical damage to the top membrane seal strip and to provide a novel roof structure which can qualify for Class A fire retardancy.

BRIEF DECRIPTION OF DRAWINGS

Figure 3:
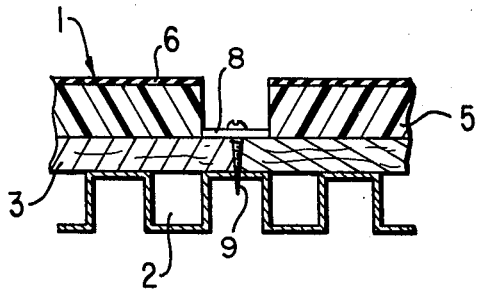

FIGS. 3, 4, and 5 are views in section showing various stages in the on-site fastening and sealing of the double membrane roofing panels;

FIG. 6 is a view in section showing the sealing of the roof structure at the roof perimeter;

FIG. 7 shows a view in section of the seal at projections through the roof deck;

FIG. 8 is a view in section showing an alternative mode of forming the top membrane structure.

DESCRIPTION OF THE PREFERRED EMBODIMENTS

Figure 1:
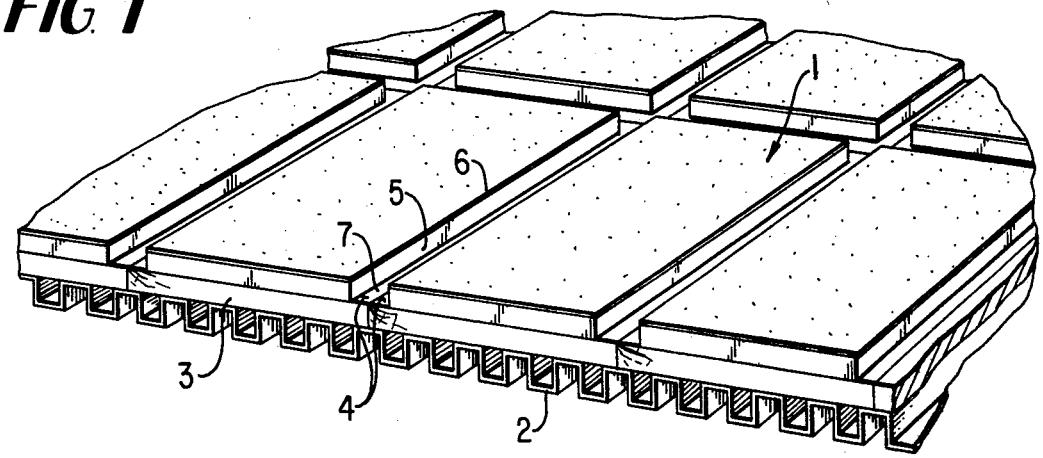
FIG. 1 is an isometric view of the roof structure prior to filling the channels or slots with joint sealer and covering with the membrane strips.

Referring to the drawings, FIG. 1 shows steel roof deck 2 of conventional construction having fastened thereto, as will be described subsequently in more detail, a rectangular double membrane roofing panel shown generally as 1. In the embodiment shown, the roofing panel substrate of Class A fire rated rigid board 3. The term "rigid" as used herein does not exclude the normal flexing of relatively long sheets of thin materials. Instead of being rectangular, the panels may have other suitable convex polygonal shapes.

The substrate boards may be made from perlite, expanded vermiculite, shale and the like. Bonded to this substrate is a lightweight insulating core 5 of slightly smaller dimensions in length and breadth so as to leave a small ledge or overhang of the substrate. The insulating core may be made of substantially closed cell polyurethane foam, or any equivalent lightweight foamed insulating material, such as substantially closed cell thermosetting foams from epoxy, isocyanurate, sulfoxy linked polyesters, polycarbonates and polystryrene, polyethylene or other polyolefinic material. Other lightweight insulating materials known in the art may be employed as well. Integral with the upper face of the insulating core 5 is an upper membrane 6 which consists of a tough, durable elastomer or plastic reinforced with fiber or fabric.

This membrane may consist of polyvinyl fluoride film having an interal layer of fabric for mechanical strength. The portion above the fabric has at least a 10-year or a 20-year rating of durability. The term "X-year rating" is widely used in the roofing trade to refer to products which will withstand the normal effects of weather and normal wear and tear for X-years from the date of insullation. Thus, a 20-year rating material will serve for 20 years. Other materials can be substituted for the reinforced polyvinyl floride film if mechanical strength and weather durability are comparable. Among materials which may be employed are butyl rubber, vinylidene chlorides and fluorides, polyesters, PVC, Neoprene, Hypalon, polysulfides, polyurethanes, polyepoxies, acrylates, etc. The thickness of the film may be selected as desired. Normally 20–30 mil thickness will be satisfactory.

The double membrane roofing panel may be fabricated by a number of procedures, as is apparent to one skilled in the art. In one method, substrate 3, foamed core 5, and upper membrane 6 are assembled into a laminate by the use of suitable adhesives. This may be done at a plant or in the field. In an alternative fabricating technique, the composite roofing panel may be formed in situ. A suitable mold is placed on substrate 3 and a synthetic organic polymeric material having a foaming agent is placed in the mold and covered with the top membrane 6. Thereafter, the mold can be closed, and heated if necessary, to form the laminate.

Still another method is a continuous line of operation wherein substrate boards are fed onto a traveling conveyor tightly butted together to appear continuous. Urethane is applied to the boards in a controlled quantity to limit the rise to a predetermined amount. A top skin is applied which serves as the top coating for the system. The entire system proceeds to a platen wherein thickness and width is controlled mechanically while the foam core undergoes aging. Still on the conveyor, the product comes out of the platen and it is cut to predetermined lengths by a cut-off saw. The edges are trimmed by side saws to predetermined widths. The boards are then fed into a router where rabbeting of the foam core is accomplished.

No separate lamination step is required since in the latter modes of operation the self-adhering properties of the resin develop the necessary bonds. With a self-sealing cellular plastic foam material such as polyurethane, an open form of proper dimensions may be employed. The form is placed on substrate 3 and is then filled with polyurethane foam (or other self-curing cellular plastic), leveled off, and covered with top membrane 6. In a relatively short time, the resin is converted from its liquid state to a substantially rigid closed cellular structure and the self-bonding properties form a strong laminate structure. Inasmuch as the double membrane panel is assembled at the factory where close control can be exercised and optimum conditions can be obtained, the resultant structure is strong, tough and of excellent roof top durability.

The panels can have any suitable dimensions. In practice, the practical requirements of construction will limit the dimensions to a size which can be handled without difficulty on the job. A panel size of 4 feet by 4 feet or 4 feet by 8 feet has been found to be satisfactory. The thickness of the substrate can be from ½ to 1½ inches. We have found ¾ inches to give good results. The foamed layer may be from ¼ to 4 inches thick, with ¾ to 1½ inches being generally preferred.

Figure 2:
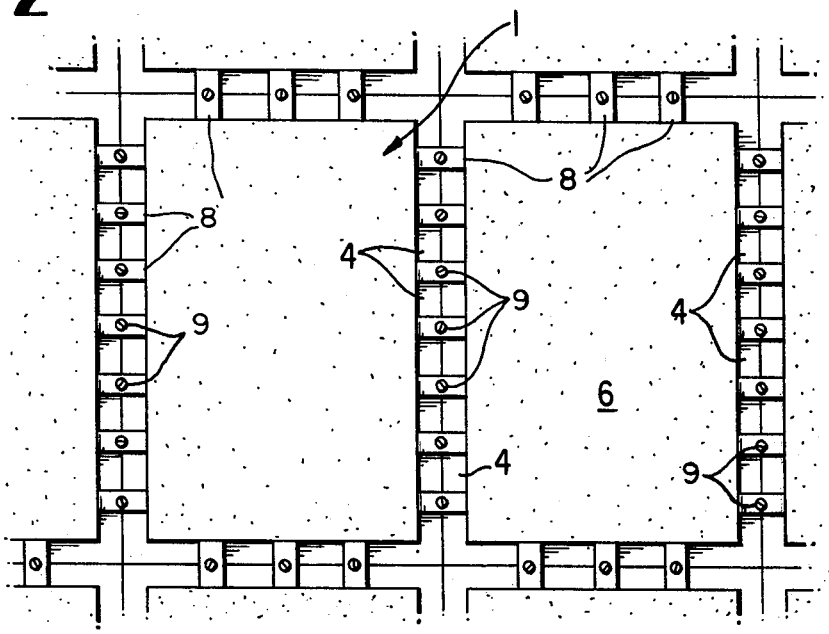
FIG. 2 is a plan view showing the double membrane roofing panel and perimeter fasteners.

The composite panels are laid on the roof deck in abutting relationship, as shown in FIG. 1. A slot or groove 7 is formed by the adjacent substrate boards, due to overlap 4 at each edge thereof. As best shown in FIG. 2, rectangular fastening strips or washers 8, equal in width to the width of slot 7, are laid in slot 7. Fasteners 9 are driven or forced through washer 8 and overlap 4, at or near the line of abutment of two overlaps, into the roof deck 2. A sufficient number of fasteners are driven through to securely fasten the panel to the roof surface. In a 4 foot by 8 foot roof panel, 24 square inches of evenly spaced fastening surface area is generally considered sufficient. With a 1 inch by 2 inch rectangular washer, a spacing of 1 foot apart would give this fastening surface area.

The fastener 9 can be a nail, screw or staple or the like. Washer 7 may have any suitable dimension or may even be in continuous strips. The important consideration is that there be a sufficient fastening surface area for the panel perimeter, i.e., at least 1 square inch per linear foot. While fastening the panels to a roof deck by the mechanical means described will often be the most effective way, they may be secured thereto by means of adhesives, such as the epoxies, urethanes, partly cured butyl elastomers, hot asphalts and bitumens, etc.

As best shown in FIGS. 3, 4, and 5, which show succesive stages respectively, in the steps of fastening, sealing and covering after the roofing panels are laid up and fastened, slots 7 are filled with polyurethane foam to seal the individual boards in place and to bond all the panels into a single monolithic mass. The foam in the slot is shown at 10 in FIG. 4. Other plastic foams such as epoxy, polyester, silicone or phenolic may be employed. After application, the foam is leveled off with the top of the roof board 1. Commerically available machines may be employed to spray the foam plastic in slot 7 and then smooth off the surface.

Other insulating and sealing compositions may be employed to fill the slot. A mastic type seal made with commerically available caulking compounds such as butyl elastomers, Thiokols, neoprenes, silicones, etc. is satisfactory. Various fillers, such as expanded perlite, can improve their insulation efficiency. The seal may also be made by tamping in a compressable, flexible material which presses against the bottom and sides of the slot continuously as, for example, elastomer gasket strips. Another type of seal which may be employed is the combination of a preformed channel filler and a mastic. Any insulation in the core which is cut away to make the seal must be replaced by material which provides equivalent insulation. In addition to the above sealing materials, thermoplastic hot melts may be employed. Another type seal which may be employed is a flexible organic polymer strip impregnated with a sticky adhesive, e.g. rubber or butyl compounds. This is compressed to about 50% of its connection area and inserted into the slot.

After the joint sealer 10 has set and is hard, a top membrane sealing strip 11, generally of the same material as the factory bonded top membrane 6, is applied to cover the sealer 10. However, if desired, a membrane of different composition may be employed. The strip is about two or three times the width of the slot 7 and is bonded to the membrane portion of roof board 1 by means of an adhesive applied along the edges of the strip. In fastening the strip to the top membrane, it may be desirable to avoid any adherence to the joint seal 10. This permits relative motion between the strip and foam sealer, avoiding the reason for previous failures of tape seals. However, as previously indicated, where the sealer is properly selected, it is possible to adhere the joint seal to the sealing strip. Where two sealing strips cross, any voids can be filled with a compatible mastic.

Usually the sealing strip will be self-adhering for ease of application. The adhesive, which may be a partially cured butyl elastomer, urethane, epoxy, acrylic, Thiokol, etc. is applied to the edge of the strip in the factory and then covered with paper. Prior to use, the paper is removed, which exposes the adhesive. However, although more troublesome, field application of the adhesive may be employed.

In the modification shown in FIG. 8, the top membrane is affixed in situ in the field. Here, the panel attached to the roof consists of substrate board 3 having insulating core 5 thereon, with slot or groove 7 formed by adjacent boards 3. As in the modification of FIG. 1–5, the slot 7 is filled with a joint sealer 10 which is leveled off even with the top of boards 5. The top surfaces of the boards 5 and joint sealer 10 are then coated with polyvinyl fluoride, an elastomer such as butyl rubber, a polyester resin, or with other membrane forming materials described in connection with membrane 6, reinforced, if desired, with a fabric such as a textile or Fiberglass. The reinforcing material, if employed, is laid in position over the boards 5 and joint sealer 10 and the coating composition is sprayed thereon by means of an applicator 15 communicating with a supply of said composition. Sufficient coating composition 16 is sprayed to saturate any reinforcement employed and to form a membrane layer 17 of desired thickness which bonds to the underlying insulating core and joint seal. As is apparent, the membrane 17 will be a unitary sheet without any joints.

As a further alternative, instead of laying a reinforcing fiber mat on the surface and saturating it with the coating composition, chopped fibers may be added to the composition as, for example, glass fibers with polyester resin and the mixture sprayed on the surface.

In situations where fire retardation is not important, substrates other than mineral boards may be employed, such as plywood panels or composition board.

The roof structure may be sealed to a parapet or a projection from the roof deck by building up along the vertical wall with sealing mastic or foam and covering it with a membrane strip. As previously described, membranes 11 are not bonded to the sealer, but are attached to membrane 1 and the parapet or projection by adhesives or other means.

This is shown in FIG. 6. In the figure, a filler strip 3*a* is cut to a suitable size from a substrate board to fill in the distance between the edge of board 3 and the parapet of wall 14. The board and filler then are attached to roof deck 2 by means of fastener 9 and washer 8. Thereafter the space between parapet 14, board 3 and filler 3*a* is filled with polyurethane foam 10 or its equivalent, as shown in the drawing. The joint seal is then covered with membrane 11 which is adhesively fastened along one edge to upper membrane 6 of roofing panel 1. At the parapet end, membrane 11 is fastened to the parapet by means of a fastener 12, and adhesive if desired. The upper part of membrane 11 and the top of the parapet are covered by a parapet cap, flashing or cover 13.

FIG. 7 shows the method for treating the roof where boards have been trimmed on site to fit around projections on the roof deck, such as a pipe or duct. As shown in the drawing, a fastener 9 is driven through the double membrane 1 to roof deck 2 close to the projection. Plastic foam or other sealer 10 is then placed in a welt around the area, covering the fastener. Membrane 11 is then placed over the sealer and fastened to upper membrane 6 and the projection by a suitable adhesive.

What is claimed is:

1. In combination with a roof deck, a roof structure comprising:

a. a plurality of abutting rectangular panels, each panel comprising:
   1. a rigid rectangular fire resistant substrate having an upper and lower surface and having fastened on the upper surface and generally centered thereon;
   2. a substantially rigid core of insulation comprising a synthetic organic polymer closed cell foam, having an upper surface;
   3. said core being of similar geometrical shape but somewhat smaller in size than the substrate, so that the edge of the substrate extends beyond the edge of the core and forms an overlap;

b. said rectangular panel being capable of being bound on all of its sides by abutting like panels and wherein said panels are so bounded in the roof structure except at the perimeters thereof;

c. the abutting edges of the substrates and the adjacent core edges forming channels or slots;

d. washer means for fastening the panels to the roof deck extending over two adjacent substrate overlaps and attachment means passing through the washer means into the roof deck to fasten the roof structure thereto;

e. said channels being filled with joint sealer means comprising polyurethane foam which joins the adjacent panels together; and f. tough, weather resistant membrane means covering the roof structure and bonded thereto, said membrane means being bonded to the upper surface of each of the panel cores and the joint sealers.

2. The roof structure of claim 1 wherein:

a. the core comprises closed polyurethane foam;

b. the membrane comprises polyvinyl fluoride; and c. the fire-resistant panel comprises bonded perlite.

3. The roof structure of claim 1 wherein the weather resistant membrane means comprises a first membrane covering the upper surface of the core and bonded thereto and a second membrane strip wider than the channel and covering the joint sealer therein, said strip bonded at least to the first membrane.

4. The roof structure of claim 3 wherein;

a. the core comprises closed polyurethane foam;

b. the membrane comprises polyvinyl fluoride; and c. the fire-resistant panel comprises bonded perlite.

5. The roof structure of claim 4 wherein the second membrane strip is bonded solely to the first membrane.

* * * * *